US011121449B2

(12) United States Patent
Chang et al.

(10) Patent No.: US 11,121,449 B2
(45) Date of Patent: Sep. 14, 2021

(54) ELECTRONIC DEVICE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 47 days.

(21) Appl. No.: 16/710,609

(22) Filed: Dec. 11, 2019

(65) Prior Publication Data

US 2021/0075085 A1 Mar. 11, 2021

(30) Foreign Application Priority Data

Sep. 10, 2019 (TW) ..... 108132544

(51) Int. Cl.

| | |
|---|---|
| ***H01Q 1/22*** | (2006.01) |
| ***H01Q 5/307*** | (2015.01) |
| ***H01Q 21/28*** | (2006.01) |

(52) U.S. Cl.

CPC ..... *H01Q 1/22* (2013.01); *H01Q 5/307* (2015.01); *H01Q 21/28* (2013.01)

(58) Field of Classification Search

CPC ..... H01G 1/22; H01G 5/307; H01G 21/28
See application file for complete search history.

(56) References Cited

U.S. PATENT DOCUMENTS

| | | | |
|---|---|---|---|
| 9,948,002 B2 | 4/2018 | Heikura et al. | |
| 10,224,630 B2 | 3/2019 | Iellci | |
| 2004/0108957 A1 | 6/2004 | Umehara et al. | |
| 2019/0006735 A1* | 1/2019 | Lee | H01Q 9/42 |

FOREIGN PATENT DOCUMENTS

| | | |
|---|---|---|
| CN | 104737367 B | 12/2018 |
| TW | M532668 U | 11/2016 |
| TW | I604662 B | 11/2017 |

OTHER PUBLICATIONS

Chinese language office action dated Apr. 22, 2020, issued in application No. TW 108132544.
European Search Report dated May 19, 2020, issued in application No. EP 19212171.3.

* cited by examiner

*Primary Examiner* — Graham P Smith
(74) *Attorney, Agent, or Firm* — McClure, Qualey & Rodack, LLP

(57) ABSTRACT

An electronic device includes a proximity sensor, an antenna structure, and a sensing pad. The antenna structure includes a first radiation element and a second radiation element which are separate from and adjacent to each other. The first radiation element has a feeding point. The second radiation element is coupled to a ground voltage. The sensing pad is adjacent to the antenna structure. The sensing pad includes a main branch, a first branch, and a second branch. The main branch is coupled to the proximity sensor. The first branch and the second branch are coupled to the main branch. The second branch has a meandering shape. The antenna structure covers a first frequency band and a second frequency band. The resonant frequency of the sensing pad is neither within the first frequency band nor within the second frequency band.

16 Claims, 6 Drawing Sheets

ELECTRONIC DEVICE

CROSS REFERENCE TO RELATED APPLICATIONS

This application claims priority of Taiwan Patent Application No. 108132544 filed on Sep. 10, 2019, the entirety of which is incorporated by reference herein.

BACKGROUND OF THE INVENTION

Field of the Invention

The disclosure generally relates to an electronic device, and more particularly, it relates to an electronic device for integrating a sensing pad with an antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable components of mobile devices for wireless communication. To meet the requirement of SAR (Specific Absorption Rate) made by the government, a designer often controls RF (Radio Frequency) power relative to an antenna element by incorporating a proximity sensor (P-sensor) into a mobile device. However, the sensing pad and the antenna element may seriously interfere with each other if the resonant frequency of the sensing pad of the P-sensor is close to the operation frequency of the antenna element. Accordingly, there is a need to propose a novel solution to overcome the problems of the prior art.

BRIEF SUMMARY OF THE INVENTION

In an exemplary embodiment, the disclosure is directed to an electronic device which includes a proximity sensor, an antenna structure, and a sensing pad. The antenna structure includes a first radiation element and a second radiation element which are separate from and adjacent to each other. The first radiation element has a feeding point. The second radiation element is coupled to a ground voltage. The sensing pad is adjacent to the antenna structure. The sensing pad includes a main branch, a first branch, and a second branch. The main branch is coupled to the proximity sensor. The first branch is coupled to a first connection point on the main branch. The second branch is coupled to a second connection point on the main branch. The second branch has a meandering shape. The antenna structure covers a first frequency band and a second frequency band. The resonant frequency of the sensing pad is neither within the first frequency band nor within the second frequency band.

In some embodiments, the first frequency band is from 2400 MHz to 2500 MHz, and the second frequency band is from 5150 MHz to 5850 MHz.

In some embodiments, the first radiation element substantially has a relatively short L-shape. The length of the first radiation element is substantially equal to 0.25 wavelength of the second frequency band.

In some embodiments, the second radiation element substantially has a relatively long L-shape. The length of the second radiation element is substantially equal to 0.25 wavelength of the first frequency band.

In some embodiments, the resonant frequency of the sensing pad is within a third frequency band or a fourth frequency band. The third frequency band is from 3000 MHz to 4500 MHz. The fourth frequency band is above 6000 MHz.

In some embodiments, the main branch of the sensing pad substantially has a straight-line shape. The first branch and the main branch are substantially perpendicular to each other.

In some embodiments, the second branch of the sensing pad substantially has a J-shape.

In some embodiments, the total length of the main branch and the first branch is substantially equal to 0.5 wavelength of the fourth frequency band.

In some embodiments, the total length of the main branch and the second branch is substantially equal to 0.5 wavelength of the third frequency band.

In some embodiments, the sensing pad further includes a widening branch coupled to the main branch. The combination of the main branch and the widening branch substantially has a rectangular shape.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
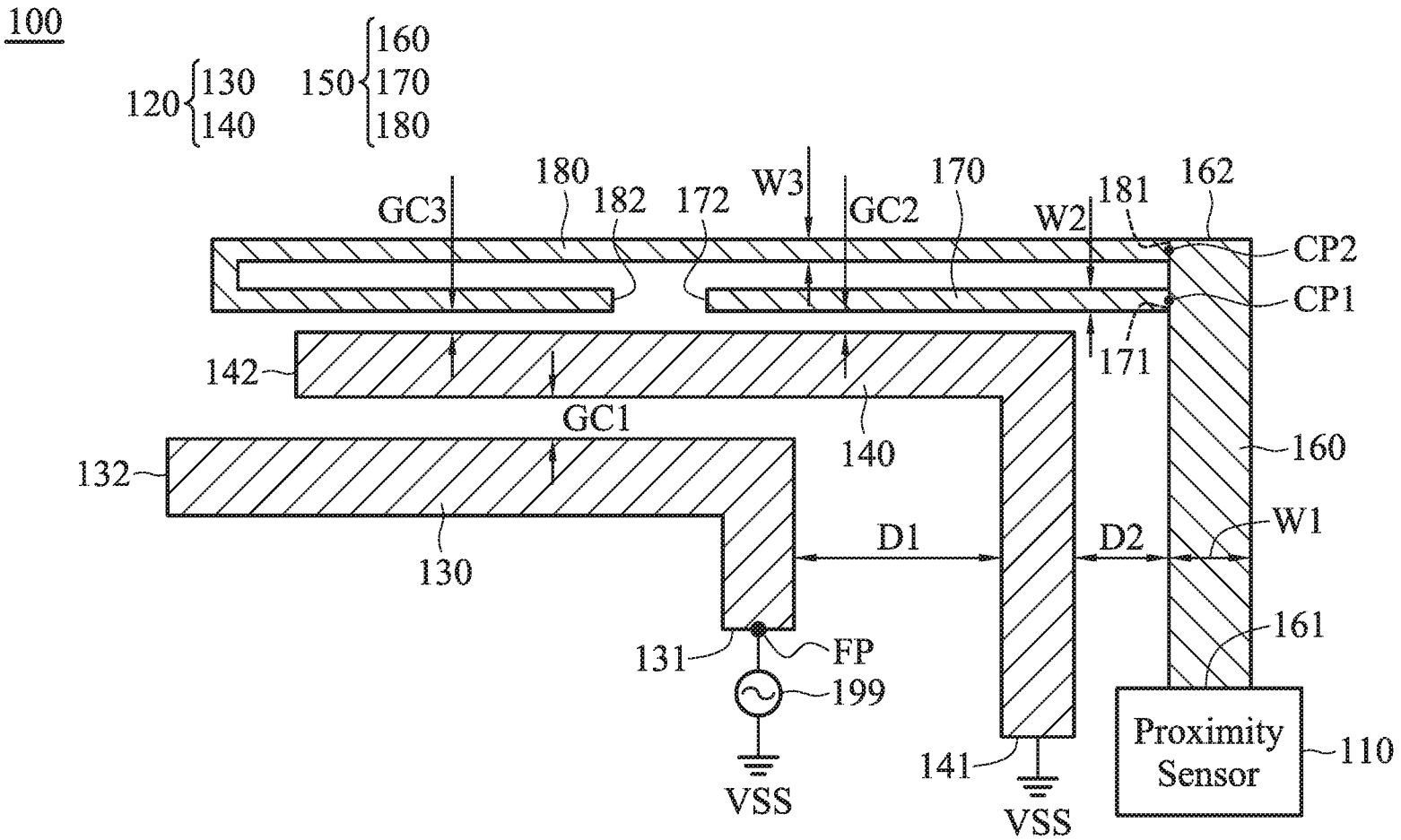
FIG. 1 is a top view of an electronic device according to an embodiment of the invention.

FIG. 1 is a top view of an electronic device 100 according to an embodiment of the invention. The electronic device 100 is applicable to a mobile device, such as a smart phone, a tablet computer, or a notebook computer. As shown in FIG. 1, the electronic device 100 includes a proximity sensor (P-sensor) 110, an antenna structure 120, and a sensing pad 150. The antenna structure 120 and the sensing pad 150 may be made of metal materials, such as copper, silver, aluminum, iron, or their alloys. In some embodiments, the antenna structure 120 and the sensing pad 150 are disposed on a dielectric substrate, such as an FR4 (Flame Retardant 4) substrate, a PCB (Printed Circuit Board), or an FCB (Flexible Circuit Board).

The antenna structure 120 includes a first radiation element 130 and a second radiation element 140 which are separate from and adjacent to each other. It should be noted that the term "adjacent" or "close" over the disclosure means that the distance (spacing) between two corresponding elements is smaller than a predetermined distance (e.g., 10 mm or shorter), but often does not mean that the two corresponding elements directly touch each other (i.e., the aforementioned distance/spacing therebetween is reduced to 0).

The first radiation element 130 may substantially have a relatively short L-shape. Specifically, the first radiation element 130 has a first end 131 and a second end 132. A feeding point FP is positioned at the first end 131 of the first radiation element 130. The second end 132 of the first radiation element 130 is an open end. The feeding point FP may be coupled to a signal source 199. For example, the signal source 199 may be an RF (Radio Frequency) module for exciting the antenna structure 120.

The second radiation element 140 may substantially have a relatively long L-shape. Specifically, the second radiation element 140 has a first end 141 and a second end 142. The first end 141 of the second radiation element 140 is coupled to a ground voltage VSS. The second end 142 of the second radiation element 140 is an open end. The second end 142 of the second radiation element 140 and the second end 132 of the first radiation element 130 may substantially extend in the same direction. A first coupling gap GC1 may be formed between the second radiation element 140 and the first radiation element 130, such that the second radiation element 140 can be excited by the first radiation element 130 using a coupling mechanism.

The sensing pad 150 is disposed adjacent to the antenna structure 120. Specifically, the sensing pad 150 includes a main branch 160, a first branch 170, and a second branch 180. The second branch 180 has a meandering shape. The sensing pad 150 may have a variable-width structure. For example, the width W1 of the main branch 160 may be greater than the width W2 of the first branch 170, and may be greater than the width W3 of the second branch 180.

The main branch 160 may substantially have a relatively wide straight-line shape. Specifically, the main branch 160 has a first end 161 and a second end 162. The first end 161 of the main branch 160 is coupled to the proximity sensor 110. A first connection point CP1 and a second connection point CP2 are both positioned on the main branch 160. The second connection point CP2 is closer to the second end 162 of the main branch 160 than the first connection point CP1.

The first branch 170 may substantially have a relatively narrow straight-line shape, which may be substantially perpendicular to the main branch 160. Specifically, the first branch 170 has a first end 171 and a second end 172. The first end 171 of the first branch 170 is coupled to the first connection point CP1 on the main branch 160. The second end 172 of the first branch 170 is an open end. A second coupling gap GC2 may be formed between the first branch 170 and the second radiation element 140.

The second branch 180 may substantially have a relatively narrow J-shape, which includes a U-shaped bending portion. Specifically, the second branch 180 has a first end 181 and a second end 182. The first end 181 of the second branch 180 is coupled to the second connection point CP2 on the main branch 160. The second end 182 of the second branch 180 is an open end. A third coupling gap GC3 may be formed between the second branch 180 and the second radiation element 140. The second end 182 of the second branch 180 and the second end 172 of the first branch 170 may substantially extend in opposite directions, and they are close to each other but do not directly touch each other. In the embodiment of FIG. 1, the second end 182 of the second branch 180 is positioned between the body of the second branch 180 (or the longest straight-line portion of the second branch 180) and the second radiation element 140, but the invention is not limited thereto. In another embodiment, the extension direction of the second end 182 of the second branch 180 is adjustable so that it can meet different requirements.

Figure 2:
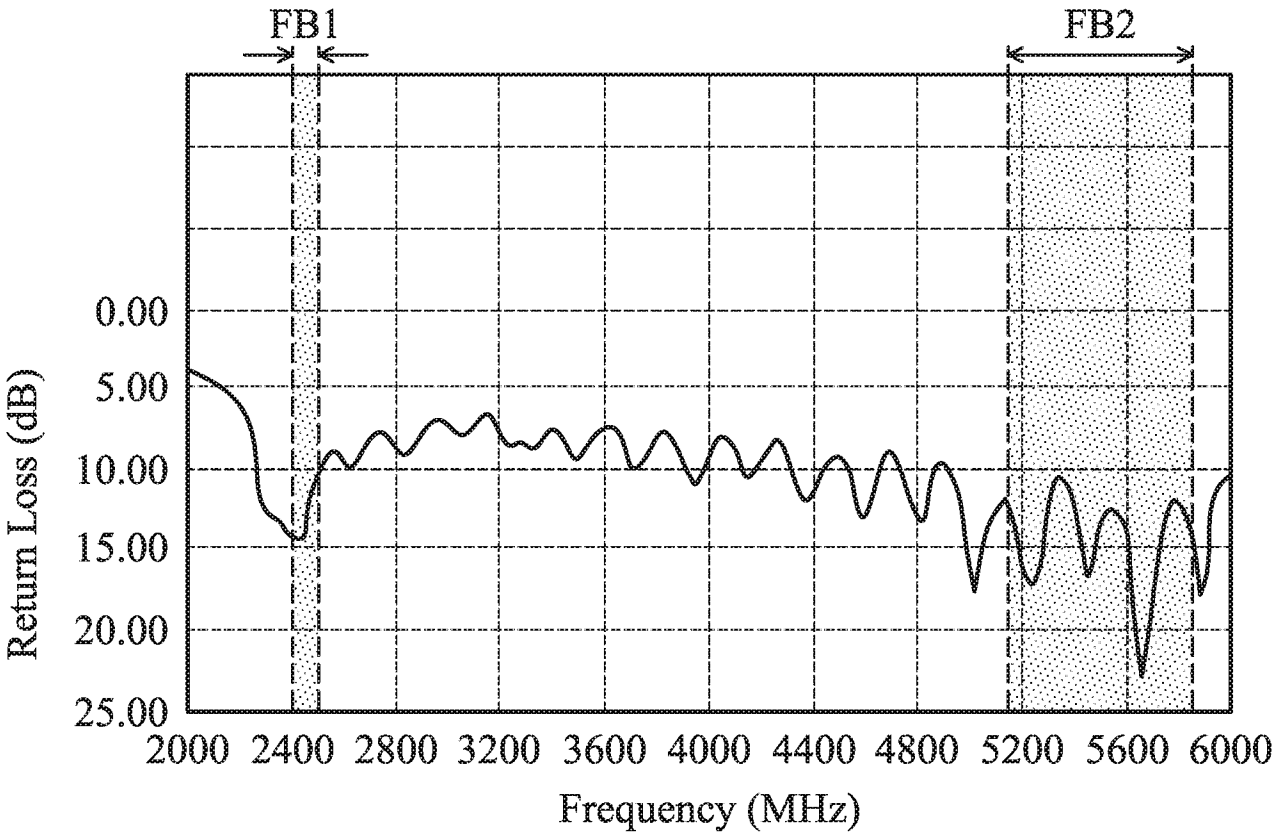
FIG. 2 is a diagram of return loss of an antenna structure of an electronic device according to an embodiment of the invention.

FIG. 2 is a diagram of return loss of the antenna structure 120 of the electronic device 100 according to an embodiment of the invention. The horizontal axis represents the operation frequency (MHz), and the vertical axis represents the return loss (dB). According to the measurement of FIG. 2, the antenna structure 120 can cover a first frequency band FB1 and a second frequency band FB2. The first frequency band FB1 may be from 2400 MHz to 2500 MHz. The second frequency band FB2 may be from 5150 MHz to 5850 MHz. Therefore, the antenna structure 120 can support at least the dual-band operations of WLAN (Wireless Local Area Networks) 2.4 GHz/5 GHz.

It should be noted that the resonant frequency of the sensing pad 150 is neither within the first frequency band FB1 nor within the second frequency band FB2. Thus, even if the sensing pad 150 is integrated with the antenna structure 120 in the electronic device 100, the sensing pad 150 may not negatively affect the radiation performance of the antenna structure 120, and the sensing pad 150 can maintain its detectable distance that is sufficiently long. In some embodiments, the resonant frequency of the sensing pad 150 is within a third frequency band or a fourth frequency band. The third frequency band may be from 3000 MHz to 4500 MHz. The fourth frequency band may be above 6000 MHz (e.g., from 6000 MHz to 8000 MHz).

In some embodiments, the element sizes of the electronic device 100 are described as follows. The length of the first radiation element 130 (i.e., the length from the first end 131 to the second end 132) may be substantially equal to 0.25 wavelength $\lambda/4$) of the second frequency band FB2. The length of the second radiation element 140 (i.e., the length from the first end 141 to the second end 142) may be substantially equal to 0.25 wavelength ($\lambda/4$) of the first frequency band FB1. The total length of the main branch 160 and the first branch 170 (i.e., the total length from the first end 161 through the first connection point CP1 to the second end 172) may be substantially equal to 0.5 wavelength (λ/2) of the fourth frequency band FB4. The total length of the main branch 160 and the second branch 180 (i.e., the total length from the first end 161 through the second connection point CP2 to the second end 182) may be substantially equal to 0.5 wavelength (λ/2) of the third frequency band FB3. The width W1 of the main branch 160 may be at least 3 times the width W2 of the first branch 170. The width W3 of the second branch 180 may be substantially equal to the width W2 of the first branch 170. The width of each of the first coupling gap GC1, the second coupling gap GC2, and the third coupling gap GC3 may be smaller than 2 mm. The distance D1 between the first radiation element 130 and the second radiation element 140 may be greater than or equal to 10 mm. The distance D2 between the second radiation element 140 and the main branch 160 may be greater than or equal to 1 mm. The above ranges of element sizes are calculated and obtained according to many experiment results, and they help to optimize the operation bandwidth and impedance matching of the antenna structure 120 and maximize the detectable distance of the sensing pad 150.

Figure 3:
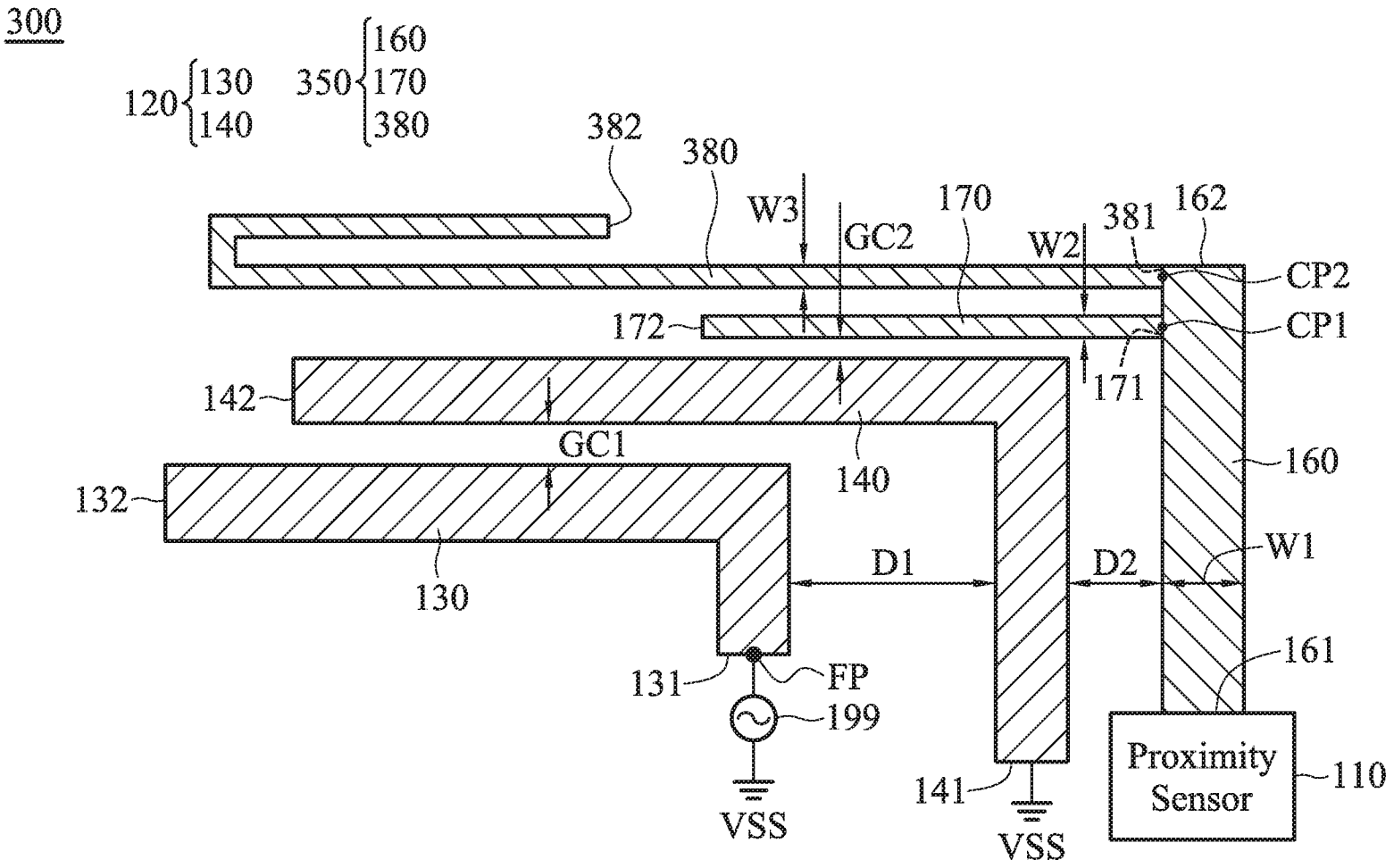
FIG. 3 is a top view of an electronic device according to another embodiment of the invention.

FIG. 3 is a top view of an electronic device 300 according to another embodiment of the invention. FIG. 3 is similar to FIG. 1. In the embodiment of FIG. 3, a second branch 380 of a sensing pad 350 of the electronic device 300 has a first end 381 and a second end 382, and the body of the second branch 380 is positioned between the second end 382 of the second branch 380 and the second radiation element 140. According to practical measurements, such a design omitting the third coupling gap GC3 does not affect the radiation performance of the antenna structure 120 so much, and it can increase the design flexibility of the electronic device 300. Other features of the electronic device 300 of FIG. 3 are similar to those of the electronic device 100 of FIG. 1. Accordingly, the two embodiments can achieve similar levels of performance.

Figure 4:
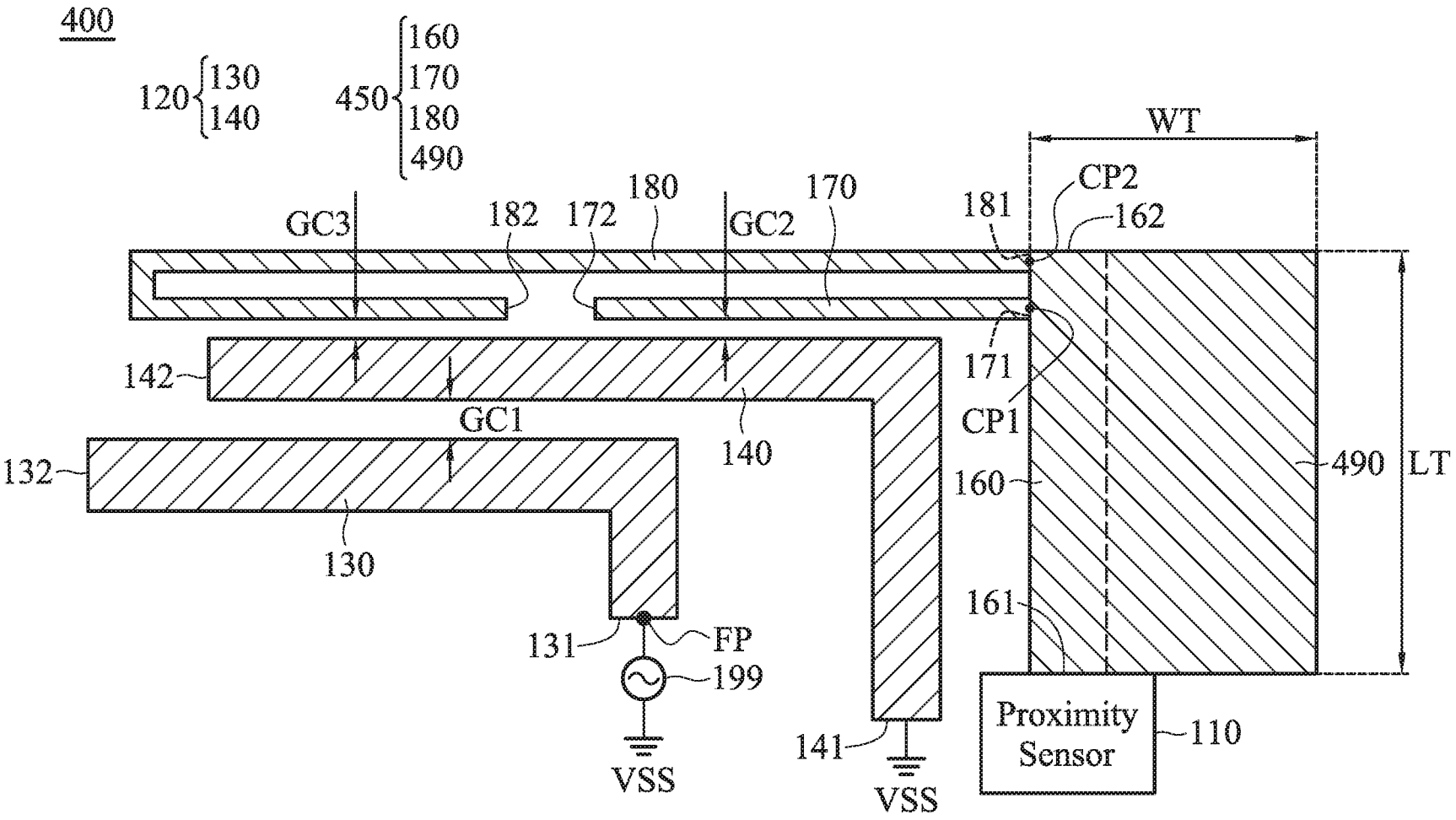
FIG. 4 is a top view of an electronic device according to another embodiment of the invention.

FIG. 4 is a top view of an electronic device 400 according to another embodiment of the invention. FIG. 4 is similar to FIG. 1. In the embodiment of FIG. 4, a sensing pad 450 of the electronic device 400 further includes a widening branch 490 coupled to the main branch 160. The combination of the main branch 160 and the widening branch 490 may substantially have a rectangular shape or a square shape. For example, the total length LT of the main branch 160 and the widening branch 490 may be smaller than or equal to 8 mm. The total width WT of the main branch 160 and the widening branch 490 may be greater than or equal to 3 mm. According to practical measurements, the incorporation of the widening branch 490 can further increases the detectable distance of the sensing pad 450. Other features of the electronic device 400 of FIG. 4 are similar to those of the electronic device 100 of FIG. 1. Accordingly, the two embodiments can achieve similar levels of performance.

Figure 5:
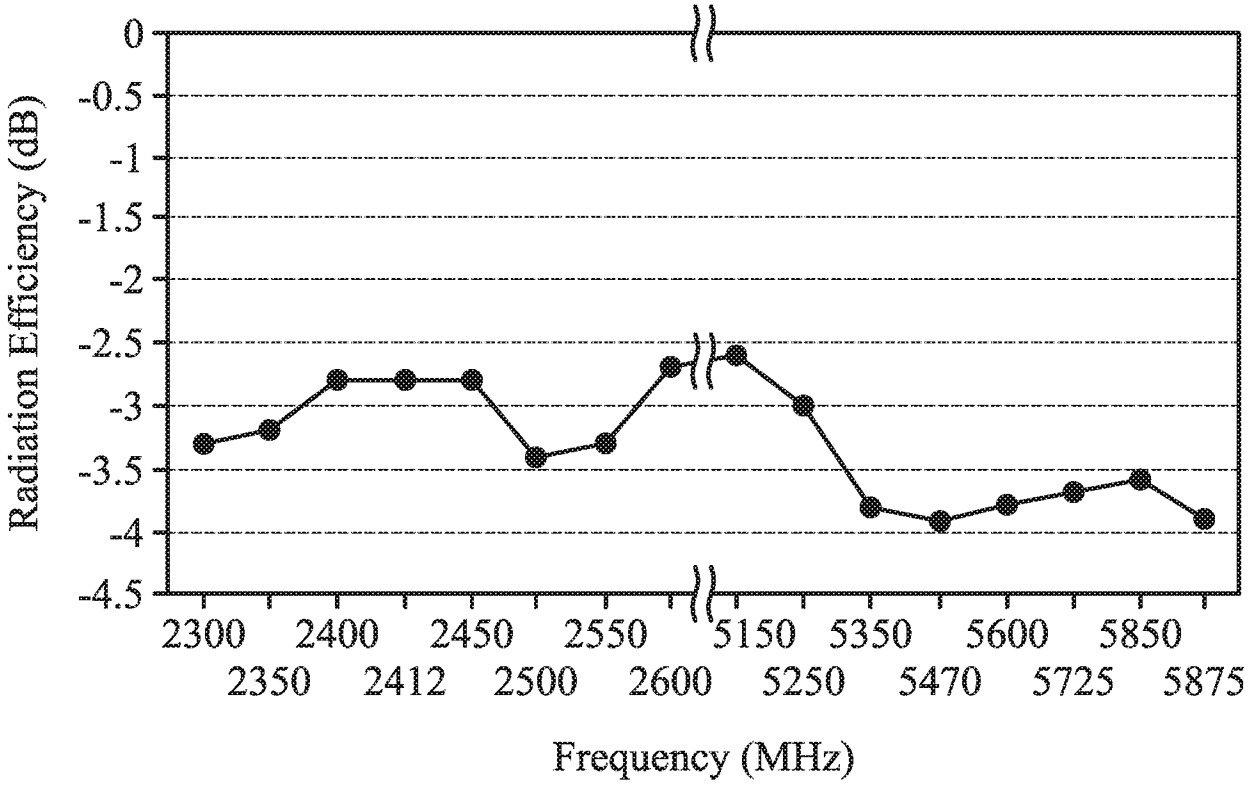
FIG. 5 is a diagram of radiation efficiency of an antenna structure of an electronic device according to another embodiment of the invention.

FIG. 5 is a diagram of radiation efficiency of the antenna structure 120 of the electronic device 400 according to another embodiment of the invention. The horizontal axis represents the operation frequency (MHz), and the vertical axis represents the radiation efficiency (dB). According to the measurement of FIG. 5, the radiation efficiency of the antenna structure 120 of the electronic device 400 can reach −4 dB or higher within the first frequency band FB1 and the second frequency band FB2. Furthermore, the detectable distance of the sensing pad 450 can reach at least 20 mm, and it can meet the requirements of practical application of general mobile communication devices.

Figure 6A:
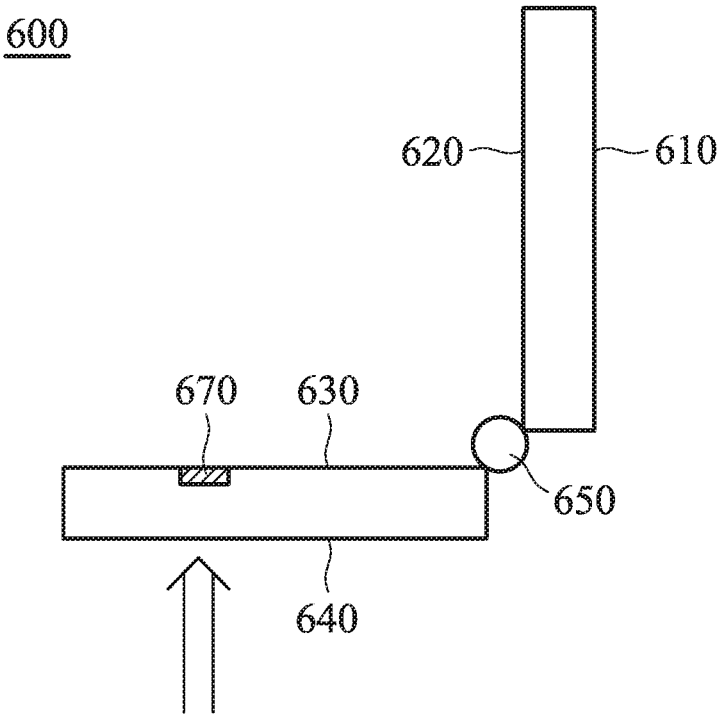
FIG. 6A is a diagram of a mobile device according to an embodiment of the invention.
Figure 6B:
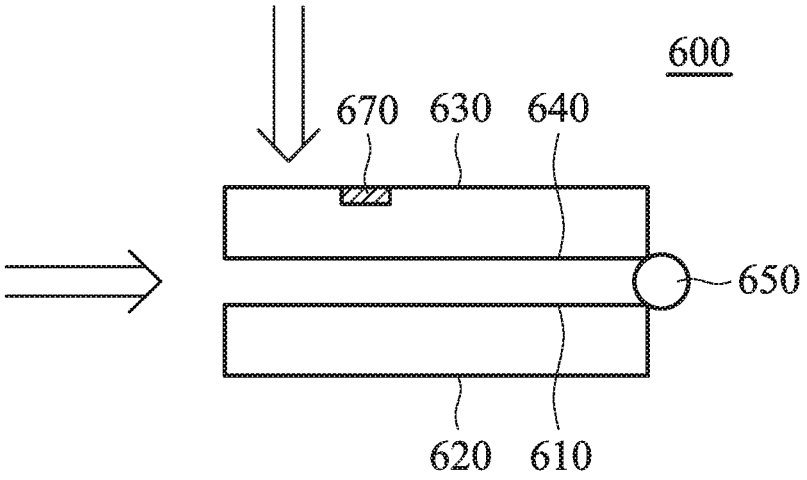
FIG. 6B is a diagram of a mobile device according to an embodiment of the invention.

FIG. 6A is a diagram of a mobile device 600 according to an embodiment of the invention. FIG. 6B is a diagram of the mobile device 600 according to an embodiment of the invention. The mobile device 600 may be a convertible notebook computer, which includes an upper cover housing 610, a display frame 620, a keyboard frame 630, a base housing 640, and a hinge element 650. The upper cover housing 610, the display frame 620, the keyboard frame 630, and the base housing 640 of the mobile device 600 are equivalent to the so-called "A-component", "B-component", "C-component", and "D-component" in the field of notebook computers, respectively. By using the hinge element 650, the mobile device 600 can operate in a notebook mode (as shown in FIG. 6A) or a tablet mode (as shown in FIG. 6B). When an SAR (Specific Absorption Rate) testing procedure is performed to the mobile device 600, its probe testing directions may be represented as the arrows displayed in FIG. 6A and FIG. 6B. The aforementioned electronic device 100 (or 300 or 400) may be disposed at a specific position 670 between the keyboard frame 630 and the base housing 640, and the electronic device 100 may directly touch the keyboard frame 630. According to practical measurements, such an integrating design can dynamically adjust the output power of the antenna structure 120, thereby significantly increasing the probability of the mobile device 600 passing the SAR test (especially for the table mode).

The invention proposes a novel electronic device for effectively integrating an antenna structure with a sensing pad. Generally, the invention has at least the advantages of increasing the radiation efficiency, increasing the detectable distance, minimizing the whole size, and reducing the whole manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the electronic device of the invention is not limited to the configurations of FIGS. 1-6. The invention may merely include any one or more features of any one or more embodiments of FIGS. 1-6. In other words, not all of the features displayed in the figures should be implemented in the electronic device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a proximity sensor;

an antenna structure, comprising a first radiation element and a second radiation element, wherein the first radiation element and the second radiation element are separate from and adjacent to each other, the first radiation element has a feeding point, and the second radiation element is coupled to a ground voltage; and a sensing pad, disposed adjacent to the antenna structure, and comprising a main branch, a first branch, and a second branch, wherein the main branch is coupled to the proximity sensor, the first branch is coupled to a first connection point on the main branch, the second branch is coupled to a second connection point on the main branch, and the second branch has a meandering shape;

wherein the antenna structure covers a first frequency band and a second frequency band, and a resonant frequency of the sensing pad is neither within the first frequency band nor within the second frequency band;

wherein the first radiation element substantially has a relatively short L-shape.

2. The electronic device as claimed in claim 1, wherein the first frequency band is from 2400 MHz to 2500 MHz, and the second frequency band is from 5150 MHz to 5850 MHz.

3. The electronic device as claimed in claim 2, wherein a length of the first radiation element is substantially equal to 0.25 wavelength of the second frequency band.

4. The electronic device as claimed in claim 1, wherein the second radiation element substantially has a relatively long L-shape.

5. The electronic device as claimed in claim 2, wherein a length of the second radiation element is substantially equal to 0.25 wavelength of the first frequency band.

6. The electronic device as claimed in claim 1, wherein the resonant frequency of the sensing pad is within a third frequency band or a fourth frequency band, the third frequency band is from 3000 MHz to 4500 MHz, and the fourth frequency band is above 6000 MHz.

7. The electronic device as claimed in claim 1, wherein the main branch of the sensing pad substantially has a straight-line shape.

8. The electronic device as claimed in claim 1, wherein the first branch and the main branch are substantially perpendicular to each other.

9. The electronic device as claimed in claim 1, wherein the second branch of the sensing pad substantially has a J-shape.

10. The electronic device as claimed in claim 6, wherein a total length of the main branch and the first branch is substantially equal to 0.5 wavelength of the fourth frequency band.

11. The electronic device as claimed in claim 6, wherein a total length of the main branch and the second branch is substantially equal to 0.5 wavelength of the third frequency band.

12. The electronic device as claimed in claim 1, wherein the sensing pad further comprises a widening branch coupled to the main branch.

13. The electronic device as claimed in claim 12, wherein a combination of the main branch and the widening branch substantially has a rectangular shape.

14. The electronic device as claimed in claim 1, wherein a width of the main branch is at least 3 times a width of the first branch.

15. An electronic device, comprising:

a proximity sensor;

an antenna structure, comprising a first radiation element and a second radiation element, wherein the first radiation element and the second radiation element are separate from and adjacent to each other, the first radiation element has a feeding point, and the second radiation element is coupled to a ground voltage; and a sensing pad, disposed adjacent to the antenna structure, and comprising a main branch, a first branch, and a second branch, wherein the main branch is coupled to the proximity sensor, the first branch is coupled to a first connection point on the main branch, the second branch is coupled to a second connection point on the main branch, and the second branch has a meandering shape;

wherein the antenna structure covers a first frequency band and a second frequency band, and a resonant frequency of the sensing pad is neither within the first frequency band nor within the second frequency band;

wherein the first frequency band is from 2400 MHz to 2500 MHz, and the second frequency band is from 5150 MHz to 5850 MHz.

16. An electronic device, comprising:

a proximity sensor;

an antenna structure, comprising a first radiation element and a second radiation element, wherein the first radiation element and the second radiation element are separate from and adjacent to each other, the first radiation element has a feeding point, and the second radiation element is coupled to a ground voltage; and a sensing pad, disposed adjacent to the antenna structure, and comprising a main branch, a first branch, and a second branch, wherein the main branch is coupled to the proximity sensor, the first branch is coupled to a first connection point on the main branch, the second branch is coupled to a second connection point on the main branch, and the second branch has a meandering shape;

wherein the antenna structure covers a first frequency band and a second frequency band, and a resonant frequency of the sensing pad is neither within the first frequency band nor within the second frequency band;

wherein a width of the main branch is at least 3 times a width of the first branch.

* * * * *